United States Patent [19]

Evrard et al.

[11] 4,279,052

[45] Jul. 21, 1981

[54] FLUE WALL COKE BUILD-UP REMOVAL DEVICE

[75] Inventors: Gerald D. Evrard, Cannelton, Ind.; Henry S. Cook, Abilene, Tex.; Anthony J. Kamalich, Owensboro, Ky.

[73] Assignees: Southwire Co., Carrollton, Ga.; National Steel Corp., Pittsburgh, Pa.

[21] Appl. No.: 119,919

[22] Filed: Feb. 8, 1980

[51] Int. Cl.[3] ..... B22D 43/00

[52] U.S. Cl. ..... 15/93 A; 15/56; 15/104.09; 15/104.1 C

[58] Field of Search ..... 15/56, 93 R, 93 A, 104.09, 15/104.1 C, 104.05; 202/241

[56] References Cited

U.S. PATENT DOCUMENTS

| | | | |
|---|---|---|---|
| 3,487,841 | 1/1970 | Goodrum | 15/56 |
| 3,817,348 | 6/1974 | Jones | 15/56 |
| 3,992,745 | 11/1976 | Laurila | 15/56 |
| 3,996,637 | 12/1976 | Shibata | 15/56 |
| 4,110,863 | 9/1978 | Fujimori et al. | 15/56 X |

FOREIGN PATENT DOCUMENTS

| | | | |
|---|---|---|---|
| 48-40539 | 12/1973 | Japan | 15/104.1 C |

*Primary Examiner*—Edward L. Roberts
*Attorney, Agent, or Firm*—Herbert M. Hanegan; Frank A. Peacock; Stanley L. Tate

[57] ABSTRACT

This invention relates to a device for cleaning opposed walls of a furnace pit. The device comprises a plurality of rotating screw-type cutters for removing built-up deposits upon the opposed walls of the furnace pit, a plurality of linkage arms for carrying the plurality of rotating screw-type cutters, a plurality of air motors for independently adjusting the speed of each half of the plurality of rotating screw-type cutters along each opposed wall of the furnace pit, and universal joints for allowing floating adjustment of each of the plurality of rotating screw-type cutters against each opposed wall of the furnace pit. The device also comprises piston-cylinder arrangements for moving the plurality of rotating screw-type cutters into and out of engagement with the built-up deposits upon the opposed walls of the furnace pit, a plate for allowing lifting of the rotating screw-type cutters up and down along the opposed walls of the furnace pit, a crane for lifting the plate, a vacuum pump for sucking out deposits removed from the opposed walls of the furnace pit, and at least one overhead rail for allowing travel of the crane from one furnace pit to another furnace pit.

20 Claims, 6 Drawing Figures

FIG. 1
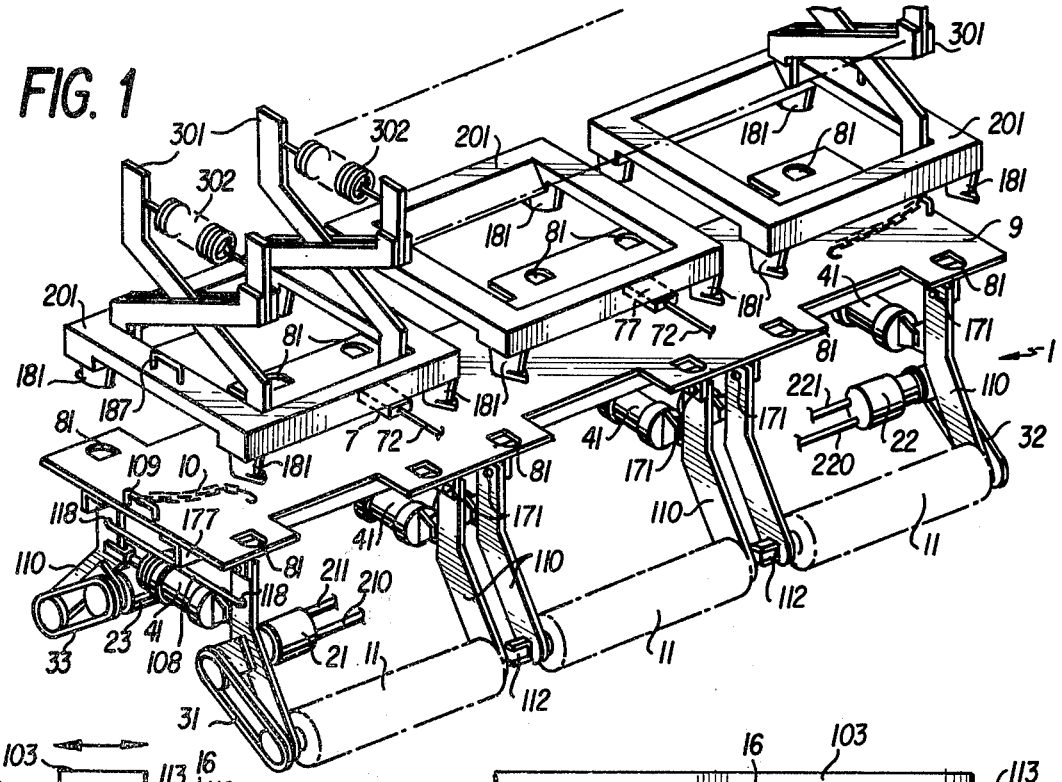
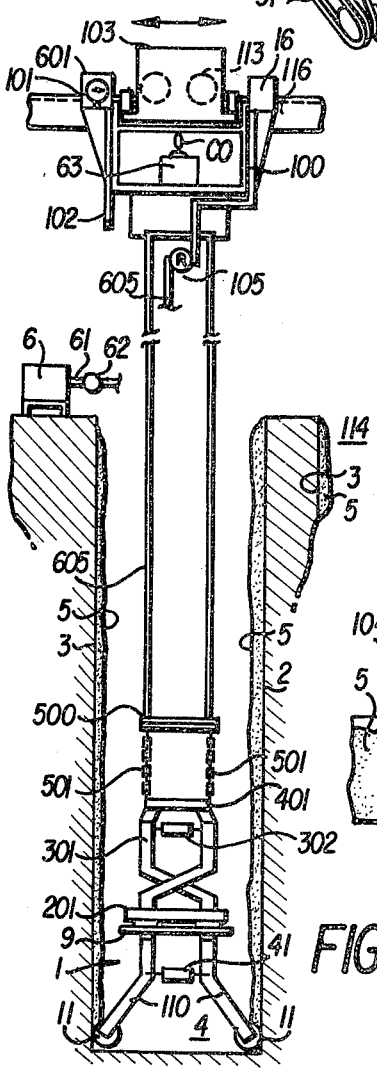
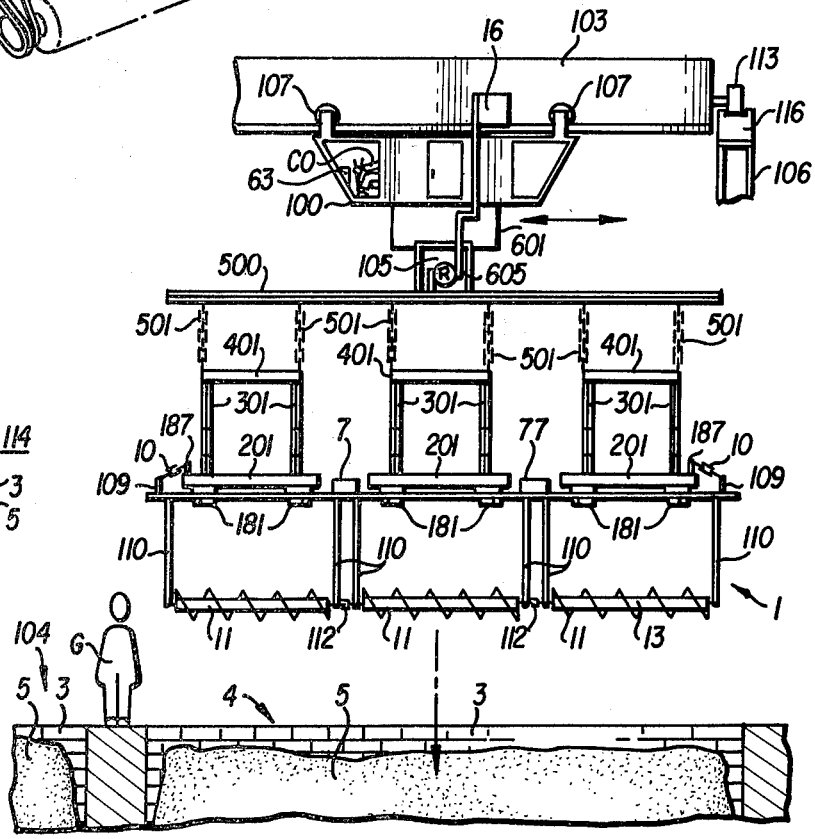
FIG. 2
FIG. 3

FLUE WALL COKE BUILD-UP REMOVAL DEVICE

BACKGROUND OF THE INVENTION

1. Field of the Invention

The invention relates to cleaning, in particular, to scraping machines.

2. Description of the Prior Art

Dust from coke built up on flue walls of furnace pits is a major source of in-plant air pollution in carbon product baking foundries. Due to the present national concern about air pollution, the U.S. Congress enacted the Occupational Safety and Health Act (hereinafter OSHA), effective April, 1971. Thereunder, regulations have been promulgated to govern the permissible dust exposure for employees inside a plant.

Before the present invention was conceived and reduced to practice, coke built up on flue walls of open-top furnace pits in carbon product baking foundries was removed by hand implements, such as scrapers, chisels, etc., operated by a plurality of workers, usually six, who would climb down into a cooled-off furnace pit in order to manually chip away and laboriously clean the entire surface of the flue walls. Such an operation ordinarily lasted a full eight-hour work day. Such labor was tedious, boring, and dangerous to the workers' health because of their constant inhalation of the coke dust. The use of protective mouth and nose respirators helped alleviate the hazards somewhat but the apparatuses were bulky and uncomfortable for the workers to wear.

Many attempts have been made to develop devices for cleaning simultaneously the opposed walls of other types of furnace pits safely and efficiently. Exemplary prior art machines for cleaning the inside of large containers are shown and described in U.S. Pat. Nos. 3,471,888, 3,992,745, and 3,996,637. However, none of these apparatuses is suitable for cleaning furnace flue walls made of refractory brick.

Therefore, it is still a problem in the cleaning art to manufacture a safe and effective device for cleaning simultaneously opposed walls of an open-top furnace pit in a carbon product baking foundry.

SUMMARY OF THE INVENTION

This invention provides a safe and effective device for cleaning simultaneously opposed walls of an open-top furnace pit in a carbon product baking foundry.

It is a primary object of the invention to provide a device for removing built-up deposits upon the opposed walls of the furnace pit with a minimum of in-plant air pollution caused by coke dust.

It is an additional object of the invention to reduce the number of employees needed to clean the wall surfaces from a maximum of six unskilled laborers working inside the cooled-down furnace pits to a maximum of two semi-skilled workers, working outside the hot furnace pits. These two workers consist of a crane operator for maneuvering the cleaning device and a guide on the ground for directing the movement of the cleaning device inside the furnace pit.

It is a further object of the invention to quickly and efficiently clean simultaneously opposed walls inside the furnace pit in a maximum of two passes over the walls, even though the walls are irregular in contour, in a matter of minutes rather than in a manual operation over a matter of a working day.

Briefly stated, these and other objects of the present invention are accomplished by providing a device for cleaning opposed walls of a furnace pit. The device comprises a plurality of means for removing built up deposits upon the opposed walls of the furnace pit, means for carrying the plurality of removing means, means for independently adjusting the speed of each of the plurality of removing means along each opposed wall of the furnace pit, and means for allowing floating adjustment of each of the plurality of removing means against the opposed walls of the furnace pit.

The device also comprises means for moving the plurality of removing means into and out of engagement with the built-up deposits upon the opposed walls of the furnace pit, means for allowing lifting of the removing means up and down along the opposed walls of the furnace pit, means for lifting the means for allowing lifting together with the carrying means and removing means, means for sucking out built up deposits removed from the opposed walls of the furnace pit, means for allowing travel of the lifting means from the furnace pit to another furnace pit, and means for safely holding the carrying means and the removing means to a plurality of engaging means in the event of breakage of the means for allowing lifting.

DESCRIPTION OF THE DRAWINGS

FIG. 1 is an exploded fragmentary perspective view of a preferred embodiment of the invention and depicts the cleaning device;

FIG. 2 is a fragmentary side elevational view of the cleaning device illustrated in FIG. 1 and depicts the cleaning device being lowered into a furnace pit to be cleaned;

FIG. 3 is an end view of the cleaning device of FIG. 1 and depicts the cleaning device at the bottom of the furnace pit being cleaned;

DESCRIPTION OF THE PREFERRED EMBODIMENT

Figure 4:
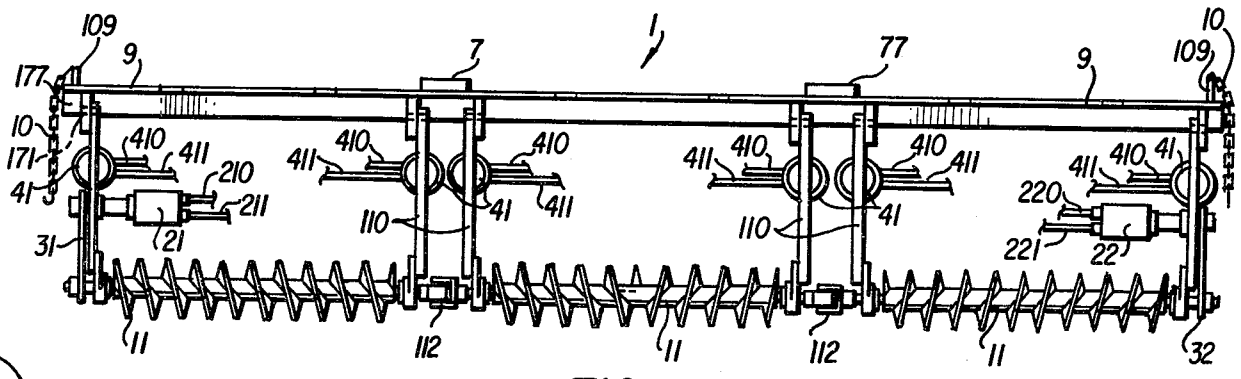
FIG. 4 is a side view of a portion of the cleaning device of the present invention and depicts in detail the rotatable screw-type cutting elements thereof.

In FIG. 1, there is shown a perspective view of a device 1 for cleaning opposed walls 2 and 3 of a furnace pit 4 shown in FIGS. 2 and 3. The cleaning device 1 comprises a plurality of horizontally-oriented rotating screw-type cutters 11 shown in FIGS. 1–5 for removing built-up deposits 5 upon the opposed walls 2 and 3. These built-up deposits 5 may include hardened pitch and coke which became attached to the walls 2 and 3 during the baking of carbon products (not shown) in the furnace pit 4.

In FIGS. 1–5, there are shown linkage arms 110 carrying the rotating screw-type cutters 11. In FIGS. 1, 2 and 4, universal joints 112 are connected to adjacent pairs of linkage arms 110 for allowing floating adjustment of each of the plurality of rotating screw-type cutters 11 against the opposed walls 2 and 3.

Figure 5:
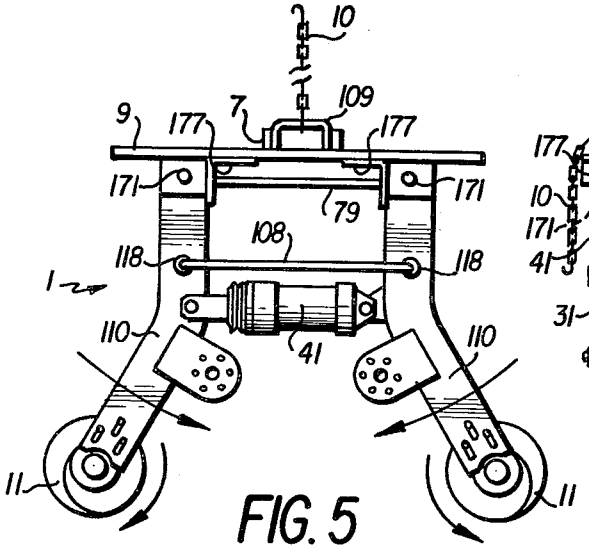
FIG. 5 is an end view of a portion of the cleaning device of the present invention and depicts in detail the piston-cylinder arrangements.

In FIGS. 1, 4 and 5, there is shown a plurality of air motors 21–24 for independently adjusting the speed of each half of the plurality of rotating screw-type cutters 11. Air motors 21 and 22 work together to independently adjust the speed of rotating screw-type cutters 11 against wall 2 while air motors 23 and 24 work together to independently adjust the speed of rotating screw-type cutters 11 against wall 3 at a higher or lower speed, in the event that the built-up deposits 5 are thicker or harder on wall 2 than on wall 3.

In FIGS. 1 and 4, there is partially shown intake hoses 210 and 220 made of rubber or other flexible material. The hoses 210 and 220 lead to air motors 21 and 22, respectively.

Figure 6:
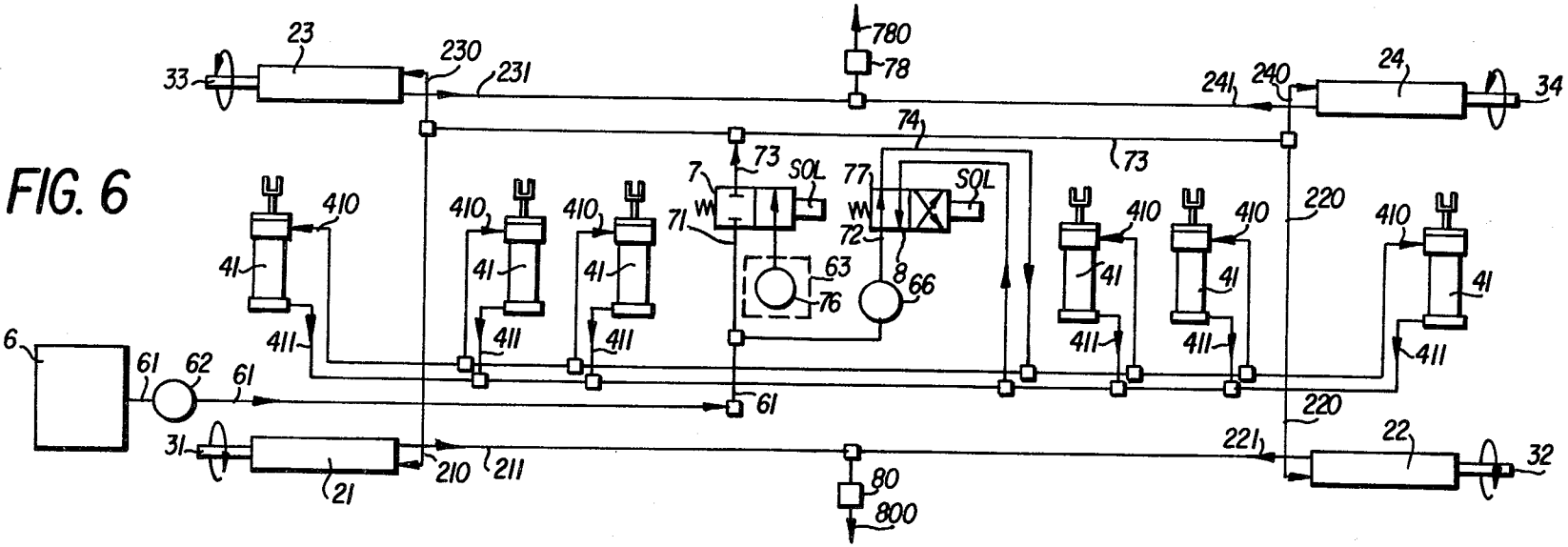
FIG. 6 is a detailed schematic view of the electrical and pneumatic control system for the cleaning device.

In FIG. 6, hoses 210 and 220, as well as hoses 230 and 240 leading to air motors 23 and 24 are shown schematically. Main hose 61 leads from a first conventional compressed air source 6 shown in FIGS. 3 and 6. A lubricator 62 drops oil periodically into the main hose 61.

A guide G on the ground, as shown in FIG. 2, in particular, controls the amount of air flowing into the plurality of air motors 21–24 by manually operating air flow exhaust valves 78 and 80 shown in FIG. 6, before the cleaning device 1 descends into the furnace pit 4. A control panel 63 is operated by crane operator CO and contains an on-off switch 76 that remotely controls a conventional two-way solenoid-operated valve 7 shown in FIGS. 1, 2, and 4–6. Intermediate hose 71 shown in FIG. 6 leads air from the main hose 61 through valve 7 into sub-hose 73.

In FIGS. 1, 4 and 6, the plurality of air motors 21–24 control drive chain arrangements 31–34 which, in turn, drive the rotating screw-type cutters 11. Thus, for example, as may be best seen in FIG. 1, air motors 21 and 22 control respective chain drive arrangements 31 and 32 which, in turn, together control half of the plurality of the rotating screw-type cutters 11.

Spent working fluid flows from air motors 21 and 22 through outlet hoses 211 and 221, shown partially in FIGS. 1 and 4 and schematically in FIG. 6, to airflow control exhaust valve 80 shown in FIG. 6. Airflow control exhaust valve 78 emits spent working fluid from air motors 23 and 24. Valves 78 and 80 control the amount of air being exhausted from air motors 21–24 and, thus, create back pressures which limit the speeds of the air motors 21–24.

In FIGS. 1, 2, and 4–6, there is shown a piston-cylinder arrangement 41 connected to a pair of oppositely arranged linkage arms 110. The piston-cylinder arrangement 41 moves the rotating screw-type cutters 11 on the end of cleaning device 1 simultaneously into and out of engagement with the built-up deposits 5 upon the opposed walls 2 and 3 of the furnace pit 4. Other piston-cylinder arrangements 41 are connected to other pairs of linkage arms 110. Air intake hoses 410 are shown partially in FIG. 4 and schematically in FIG. 6. These air intake hoses 410 lead to cylinder arrangements 41 by way of sub-hose 74.

Main hose 61 leads to a conventional on-off pressure regulator 66, shown in FIG. 6, which is manipulated by the guide G shown in FIG. 2. Intermediate hose 72, as shown in FIGS. 3 and 6, leads air from main hose 61 into sub-hose 74 through a conventional four-way, solenoid-operated valve 77 which is shown in FIGS. 1, 2, and 4–6 and which is controlled by the pressure regulator 66. Spent working fluid flows from piston-cylinder arrangements 41 through outlet hoses 411, shown partially in FIG. 4 and schematically in FIG. 6, to cylinder exhaust 8.

A plate 9 shown in FIGS. 1–5 is connected to the linkage arms 110 and allows lifting of the rotating screw-type cutters 11 up and down along the opposed walls 2 and 3 of the furnace pit 4. The plate 9 has a plurality of apertures 81, best shown in FIGS. 1 and 4, for engaging with respective dogs 181, best shown in FIGS. 1 and 2, on lifting tongs 301 operated by piston-cylinders 302 and carried by crane 100 shown in FIGS. 2 and 3.

A vacuum pump 101, also shown in FIG. 2, is connected to the crane 100 and has a suction tube 102 which may be extended down to the bottom of furnace pit 4. The vacuum pump 101 and the suction tube 102 together comprise a means for sucking out built-up deposits 5 that have been removed from the opposed walls 2 and 3 and have fallen onto the floor of the furnace pit 4.

At least one overhead rail 103 shown in FIGS. 2 and 3 cooperates with and allows travel of the crane 100 from the furnace pit 4 to another furnace pit, such as furnace pit 104, partially shown in FIG. 2, as oriented along the longitudinal axis of furnace pit 4, or, such as furnace pit 114, partially shown in FIG. 3, as oriented laterally along furnace pit 4.

Chains 10, shown in FIGS. 1, 2, 4 and 5, are connected to the plate 9 by way of handles 109 for safely holding the linkage arms 110 and the rotating screw-type cutters 11 to the dogs 181. As best seen in FIG. 1, the chains 10 are not yet hooked up to handles 187 on end lifting blocks 201 which carry dogs 181. However, in FIG. 2, the chains 10 are so hooked up. The chains 10 comprise means for safely holding the linkage arms 110 and the rotating screw-type cutters 11 to the dogs 181 in the event of breakage of one or more of the apertures 81 in the plate 9.

The operation of the invention is as follows. In FIGS. 1 and 5, screw-type cutters 11 are shown resting upon the ground and the linkage arms 110 are prevented from spreading outwardly away from each other by a holding brace 108 which engages into holes 118 in the end linkage arms 110. In FIG. 1, dogs 181 are shown descending into engagement with apertures 81 in plate 9. The dogs 181 are attached to lifting blocks 201 and are moved into and out of engagement with apertures 81 by lifting tongs 301 which are opened and closed by piston cylinders 302. Electrical signals from crane operator CO in crane 100 turns on a second compressor 16 which feeds air through hose 605 around reel R in a retractable hydraulic cylinder 105 to the piston cylinders 302. As shown in FIGS. 2 and 3, lifting tongs 301 are joined in pairs to frames 401 which are held by heavy-duty chains 501 to bar 500. Bar 500 is attached to the retractable hydraulic cylinder 105 which raises and lowers the cleaning device 1.

The crane operator CO drives the crane 100 via wheels 107 longitudinally along the overhead rail 103 which is supported at its ends by posts 106, only one of which is shown in FIG. 2. The crane operator CO may also maneuver the crane 100 laterally by driving the entire overhead rail 103 via wheels 113, shown in FIGS. 2 and 3, along track 116 at the top of posts 106.

Once the crane 100 is in its desired position, the crane operator CO throws a conventional electric switch which energizes and lowers the hydraulic cylinder 105 so that the dogs 181 penetrate the respective apertures 81 of the plate 9. The crane operator CO then throws another conventional electric switch which energizes the piston cylinders 302 and causes the lifting tongs 301 to spring outwardly so that the tips of the dogs 181 engage the apertures 81 under the plate 9. See FIG. 1, in particular.

After the apertures 81 are engaged, the guide G removes holding braces 108 and hooks safety chains 10 around handles 109 of plate 9 and around handles 187 of lifting blocks 201. The cleaning device 1 is then lifted from the ground and positioned at the top of furnace pit 4 as shown in FIG. 2 to start the cleaning process. In FIG. 3, the cleaning device 1 has reached the bottom of the furnace pit 4 and is ready to be indexed so that the remaining surface of walls 2 and 3 may be cleaned on the return trip up the furnace pit 4.

At the beginning of the cleaning process before the cleaning device 1 is lowered into the furnace pit 4, the guide G turns on compressor 6 and pressure regulator 66 so that air leaves compressor 6 and enters main hose 61. The air flows through lubricator 62 and into pressure regulator 66. Air then flows into intermediate hose 72 and through a conventional four-way, solenoid-operated valve 77, best shown schematically in FIG. 6. The air is gated into sub-hose 74 before entering the intake hose 411 of piston-cylinder arrangements 41. The entering air causes piston-cylinder arrangements 41 to act against linkage arms 110 which carry the rotating screw-type cutters 11 into contact with the built-up deposits 5 on walls 2 and 3.

The linkage arms 110 pivot outwardly about points 171 to a maximum extended position shown in FIG. 5. This maximum is determined by the distance separating opposed walls 2 and 3. The fully extended stroke of the cylinders in piston-cylinder arrangements 41 are set to this maximum in order to prevent the rotating screw-type cutters 11 from cutting into the refractory brick making up the walls 2 and 3 after the built-up deposits 5 have been initially cut away. Thus, for example, as shown in FIG. 5, linkage arms 110 pivot about points 171 but are limited in their outward movement by the full stroke of the cylinder in piston-cylinder arrangements 41.

As best shown in FIGS. 4 and 5, angle irons 177, which extend longitudinally along the underside of plate 9, aid in positioning linkage arms 110 in place. End brace 79 aids in spacing the angle irons 177 apart.

Once the rotating screw-type cutters 11 are pushed outwardly into contact with the built-up deposits 5, as shown in FIG. 3, the crane operator CO turns on the electrical switch 76 on control panel 63. As shown schematically in FIG. 6, air flows from main hose 61 through intermediate hose 71 into two-way solenoid-operated valve 7 which is controlled by the electrical switch 76. The air is then gated into sub hose 73 which leads into intake hoses 210, 220, 230 and 240 of respective air motors 21–24 which, in turn, operate respective chain-drive arrangements 31–34. See FIG. 1, in particular. Chain-drive arrangements 31 and 32 rotate half of the rotating screw-type cutters 11 against wall 2 while chain-drive arrangements 33 and 34 rotate the other half of the rotating screw-type cutters 11 against wall 3.

As seen in FIG. 3, the cutters 11 rotate and cut into the built-up deposits 5 until they reach the walls 2 and 3. The removed deposits 5 fall to the bottom of the furnace pit 4 while the crane operator CO slowly lowers the cleaning device 1 upon receiving radio or visual signals from the guide G. If the guide G observes at the beginning of a cleaning operation that there are particularly thick or hard areas of built-up deposits 5 along either wall 2 or 3, he or she may increase the speed of the respective governing air motors 21–22 and 23–24. This adjustment is accomplished by manually resetting flow control exhaust valves 78 and 80, shown schematically in FIG. 6, so that the openings of the air exits 780 and 800 are increased. This opening up of the exits 780 and 800 allows the respective air motors 23–24 and 21–22 to operate at a higher speed, thus increasing the rotation of the respective cutters 11. Likewise, if it is desirable to decrease the rate of rotation of either set of cutters 11, the guide G manually resets flow control exhaust valves 78 and 80. Decreasing the openings of the exits 780 and 800 creates a back pressure in respective air outlet hoses 231, 241 and 211, 221; consequently, the motors 21–24 operate at a lower speed, thus decreasing the rate of rotation of cutters 11.

Universal joints 112 allow floating adjustment of the adjoining pairs of cutters 11, in the event that the built-up deposits 5 are thicker on some areas of the walls 2 and 3.

Once the cleaning device 1 has reached the bottom of the furnace pit 4, it is necessary for it to be indexed in order to make a second pass in the upward direction along the walls 2 and 3 for the purpose of removing the built-up deposits 5 missed in the first downward pass. The space between adjoining pairs of cutters 11 leaves vertical strips of built-up deposits 5 along the walls 2 and 3. As may be seen in FIG. 2, the cleaning device 1 is not quite as long as the furnace pit 4 and, therefore, the crane operator CO indexes the cleaning device 1 by moving the crane 100 slightly to the left or right so that the cleaning device 1 will be in a position to have the cutters 11 remove the missed built-up deposits 5 in the second pass in the upward direction.

After the second pass is completed, the cleaning device 1 is lifted out of the furnace pit 4. The crane operator CO then maneuvers the crane 100 so that the suction tube 102 descends to the bottom of the furnace pit 4 where the removed deposits 5 have fallen. The vacuum pump 101 is turned on by the crane operator CO and the deposits 5 on the bottom of furnace pit 4 are sucked up by the suction tube 102. The deposits 5 are then moved through suction tube 102 into a storage area 601 for later disposal. When all deposits 5 are sucked up, the vacuum pump 101 is turned off, the suction tube 102 is retracted up out of furnace pit 4, and the cleaning device 1 is ready to be moved so that another furnace pit, such as longitudinally adjacent furnace pit 104 shown in FIG. 2 or laterally adjacent furnace pit 114 shown in FIG. 3, may have its built-up deposits 5 removed from its walls 2 and 3.

The foregoing preferred embodiment is considered as illustrative only. Numerous modifications and changes will readily occur to those skilled in the art.

What we claim is:

1. A device for cleaning opposed walls of a furnace pit comprising:

(a) a plurality of rotary means for removing built-up deposits upon each of the opposed walls of the furnace pit;

(b) means for carrying the plurality of removing means;

(c) means, connected to said carrying means, for independently adjusting the speed of the plurality of removing means along each opposed wall of the furnace pit; and (d) means, connected to said carrying means, for allowing floating adjustment of each of the plurality of removing means against the opposed walls of the furnace pit.

2. Device, according to claim 1, further comprising:

means, connected to the carrying means, for moving the plurality of removing means into and out of engagement with the built-up deposits upon the opposed walls of the furnace pit.

3. Device, according to claim 2, wherein:

said moving means is a piston-cylinder arrangement.

4. Device, according to claim 2, wherein:

said moving means moves the plurality of removal means simultaneously into and out of engagement with the built-up deposits upon the opposed walls of the furnace pit.

5. Device, according to claim 1, further comprising:

means, connected to the carrying means, for allowing lifting of the removing means up and down along the opposed walls of the furnace pit.

6. Device, according to claim 5, further comprising:

means, connectable to the means for allowing lifting, for lifting said means for allowing lifting together with the carrying means and the removing means.

7. Device, according to claim 6, further comprising:

means, connected to the lifting means, for sucking out built-up deposits removed from the opposed walls of the furnace pit.

8. Device, according to claim 7, wherein:

said sucking means is a vacuum pump having a suction tube.

9. Device, according to claim 6, further comprising:

means, cooperating with the lifting means, for allowing travel of the lifting means from the furnace pit to another furnace pit.

10. Device, according to claim 9, wherein:

said means for allowing travel is at least one overhead rail.

11. Device, according to claim 6, wherein:

said means for allowing lifting is a plate having a plurality of aperture means therethrough for engaging with the lifting means.

12. Device, according to claim 6, wherein:

said lifting means is a crane having a plurality of means for engaging said means for allowing lifting.

13. Device, according to claim 12, further comprising:

means, connected to the means for allowing lifting, for safely holding the carrying means and the removing means to said plurality of engaging means, in the event of breakage of the means for allowing lifting.

14. Device, according to claim 12, wherein:

said plurality of engaging means is a plurality of dogs on lifting tongs.

15. Device, according to claim 13, wherein:

said safe holding means is a chain.

16. Device, according to claim 1, wherein:

said plurality of removing means is a plurality of rotating screw-type cutters.

17. Device, according to claim 16, wherein:

said plurality of rotating screw-type cutters are horizontally oriented.

18. Device, according to claim 1, wherein:

said carrying means is a plurality of linkage arms.

19. Device, according to claim 1, wherein:

said independent speed adjusting means is a plurality of air motors.

20. Device, according to claim 1, wherein:

said means for allowing floating adjustment is a universal joint.

* * * * *